United States Patent [19]

Jekel

[11] Patent Number: 5,007,924

[45] Date of Patent: Apr. 16, 1991

[54] LUMINESCENT PACIFIER

[76] Inventor: Tina M. Jekel, 11117 Scripps Ranch Blvd., San Diego, Calif. 92131

[21] Appl. No.: 391,039

[22] Filed: Aug. 9, 1989

[51] Int. Cl.[5] ..... A61J 17/00

[52] U.S. Cl. ..... 606/234; 446/219

[58] Field of Search ..... 128/359, 360, 45, 46; 215/11.1 R; 606/234–236; 446/219

[56] References Cited

U.S. PATENT DOCUMENTS

| | | | |
|---|---|---|---|
| 1,518,823 | 12/1924 | Schmidt et al. | 128/360 |
| 3,186,411 | 6/1965 | Skidmore | 606/239 |
| 4,329,996 | 5/1982 | Copeland | 128/360 |
| 4,688,571 | 8/1987 | Tesler | 128/360 |
| 4,716,902 | 1/1988 | Swartz | 128/360 |

FOREIGN PATENT DOCUMENTS

| | | | |
|---|---|---|---|
| 2594328 | 8/1987 | France | 128/360 |
| 2169811 | 7/1980 | United Kingdom | 128/360 |

*Primary Examiner*—Michael H. Thaler
*Assistant Examiner*—William Lewis

[57] ABSTRACT

A baby's pacifier comprises a straight bar handle to facilitate the grasping of the infant, there being a cylindrical, removable clip-on luminescent sheath which clips on over the crossbar and can be removed to be charged in a bright light, and returned to the bar so that it glows in the dark to facilitate the infant's grasp of the pacifier in the dark.

2 Claims, 1 Drawing Sheet

LUMINESCENT PACIFIER

BACKGROUND OF THE INVENTION

The instant invention is in the field of baby products, and particularly relates to pacifiers.

Every parent has many memories of being awakened in the middle of the night by a crying baby. Sometimes the baby is hungry, cold or wet, but often it is because it has lost its pacifier in its sleep, and of course cannot find it in the dark.

The instant invention proposes to remedy this situation by providing a pacifier which glows in the dark. The idea of luminescent baby products is not new, and can be found in the following U.S. Pat. Nos.: 2,169,811 for a CHILD'S DUMMY HAVING A LIGHT SOURCE; 2,594,328; 3,186,411 for a LUMINOUS PACIFIER; 4,688,571 for a ONE-PIECE LUMINOUS PACIFIER; and, 4,759,453 FOR A LUMINOUS BABY BOTTLE.

Although these prior art devices address the same basic problem as does applicant, nonetheless there is a need for a pacifier which has a removable, phosphorescent charging element.

SUMMARY OF THE INVENTION

The instant invention fulfills the above-stated aim by providing a pacifier with a straight bar handle, in the preferred embodiment, to facilitate grasping by the infant.

A phosphorescent, clip-on sheath engages on the handle crossbar and can be readily removed to be put in the light, such as the sunshine or a bright fluorescent light to charge the clip up while the baby is using the pacifier during the day so that at night it will be maximally charged and will discharge its glowing light for a long period of time.

DETAILED DESCRIPTION OF THE PREFERRED EMBODIMENT

Figure 1:
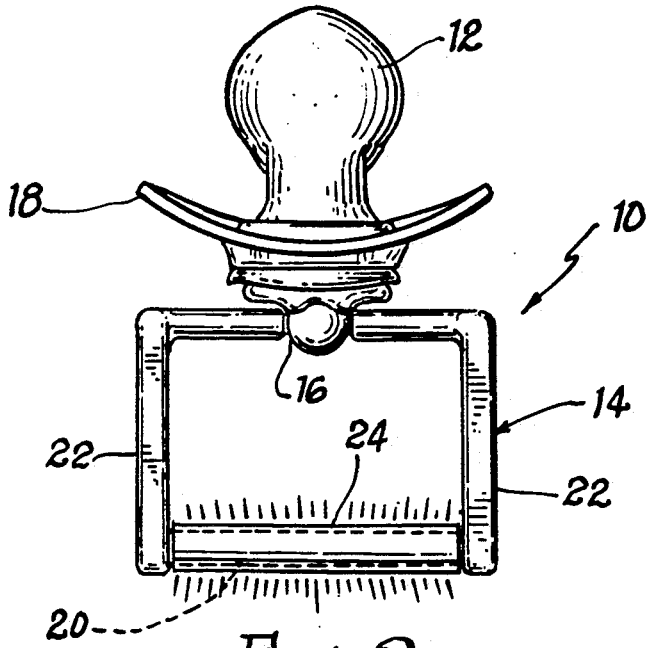
FIG. 1 is a top plan view of the invention in extended form.
Figure 2:
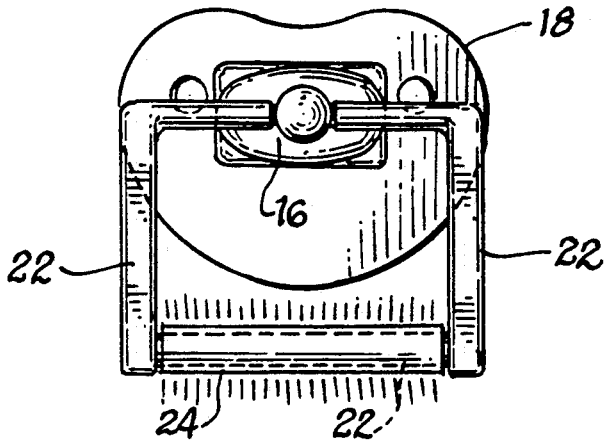
FIG. 2 is a rear elevation view of the invention with the handle swung down.
Figure 3:
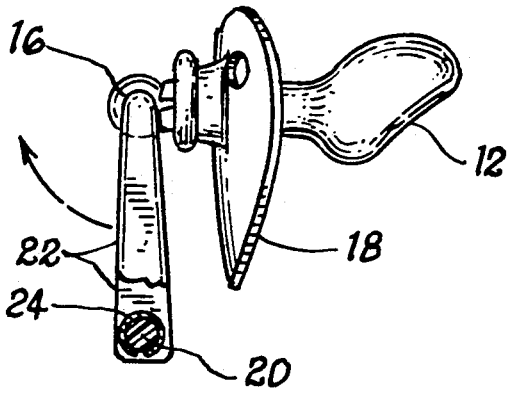
FIG. 3 is a side elevation view taken from the right side of FIG. 2; and, FIG. 4 is an isometric view of the clip in isolation.

The pacifier is shown at 10 in FIG. 1 and comprises in general a rubber nipple portion 12 and a rigid, or semi-rigid, handle portion 14. In the embodiment shown, the handle is pivotally mounted at 16 to a shield portion 18 made of the same kind of plastic. The nipple portion 12 passes through a central opening in the shield portion 18, and engages the shield in a manner used in the prior art, the details of which not being important to the invention.

The handle portion 14 has a crossbar 20 which passes straight across between a pair of supports 22 of the handle portion 14. The straight crossbar 20 is an improvement over the curved rings of most pacifiers in that it is much easier for the baby to grasp.

Figure 4:
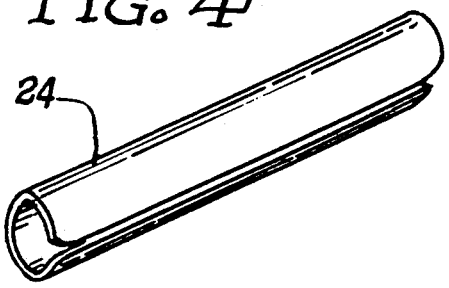

The luminescent, cylindrical snap-on clip 24 is best shown in isolation in FIG. 4. It is made of a resilient, luminescent plastic material so that it can expand with a memory to snap over the crossbar 20. Of course the crossbar and the clip-on cylinder could be square or rectangular in cross-section, or oval, etc. Also, the crossbar 20 need not be straight, but could be curved, and could even be configured as a ring as in the prior art, provided a clip 24 of similar shape were provided as the phosphorescent portion.

With the use of the instant pacifier, the mother can place the clip 24 in any well-lit place while the baby plays with the pacifier as usual. At night however, the mother or father can snap on the clip 24 to the crossbar 20, and give it to the baby, with the clip glowing at least well into the night, if not all night long, due to the crying of the baby due to the loss of its pacifier in the dark.

It is hereby claimed:

1. A luminescent pacifier comprising:

(a) a nipple portion for insertion in a baby's mouth;

(b) a handle portion connected to said nipple portion for grasping by the baby, said handle portion including a crossbar;

(c) said handle having a removable luminescent clip which removably snaps onto said bar member so that said baby can find the pacifier in the dark and the clip can be removed from the pacifier and charged up while the baby uses the pacifier in the daytime.

2. Structure according to claim 1 wherein said bar member is substantially straight to facilitate gripping by said baby, and said clip is substantially cylindrical.

* * * * *